United States Patent [19]

Rosenberg

[11] Patent Number: 4,760,957

[45] Date of Patent: Aug. 2, 1988

[54] FLOW REGULATOR AND WATER SPRINKLER INCLUDING SAME

[76] Inventor: Peretz Rosenberg, Moshave Beit Shearim, Israel

[21] Appl. No.: 16,783

[22] Filed: Feb. 20, 1987

[30] Foreign Application Priority Data

Mar. 23, 1986 [IL] Israel ..... 78235

[51] Int. Cl.[4] ..... B05B 1/30

[52] U.S. Cl. ..... 239/222.17; 239/570; 138/43

[58] Field of Search ..... 239/570, 571, 533.13, 239/499, 569, 381, 382, 222.17; 137/533; 138/43, 46

[56] References Cited

U.S. PATENT DOCUMENTS

| | | | |
|---|---|---|---|
| 3,138,177 | 6/1964 | Cutler | 239/533.13 |
| 3,697,002 | 10/1972 | Parkison | 239/570 |
| 3,995,664 | 12/1976 | Nelson | 138/43 |
| 4,005,710 | 2/1977 | Zeddies et al. | 137/533 |
| 4,570,857 | 2/1986 | Rosenberg | 239/570 |

*Primary Examiner*—Andres Kashnikow
*Assistant Examiner*—C. Trainor
*Attorney, Agent, or Firm*—Benjamin J. Barish

[57] ABSTRACT

A flow regulator comprises a housing having a passageway for a fluid flowing therethrough from its inlet to its outlet; a resilient sealing member circumscribing the inlet to the passageway; and a flow regulator member overlying the passageway inlet and spaced therefrom by a plurality of axially-extending teeth carried by the flow regulator member. The teeth are spaced circumferentially around the passageway inlet and are engageable at their outer edges with the resilient sealing member such as to define flow paths in the spaces between the teeth. The flow regulator member is movable axially of the passageway in response to the difference in pressure on its opposite faces to press the teeth to different depths into the resilient sealing member and thereby to regulate the flow through the flow paths by varying the dimensions of the spaces between the teeth.

8 Claims, 1 Drawing Sheet

FIG. 1
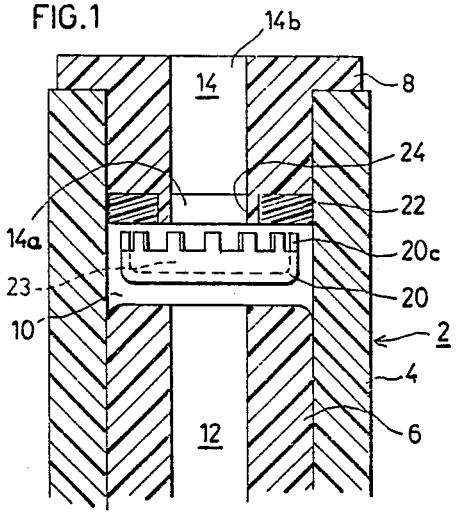
FIG 3
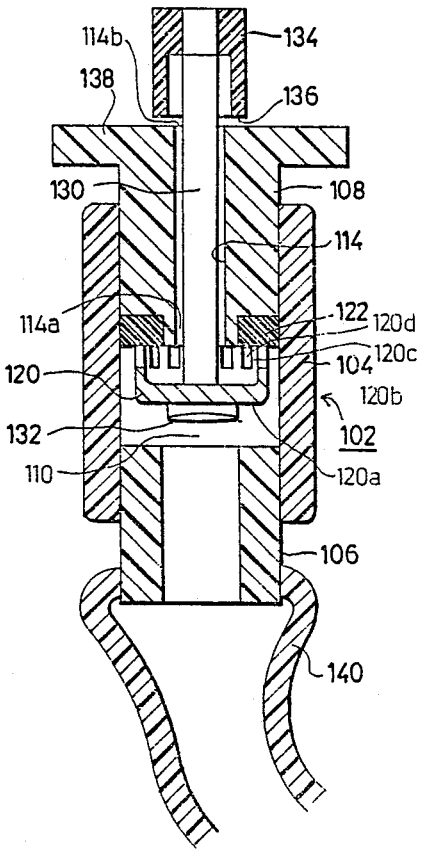
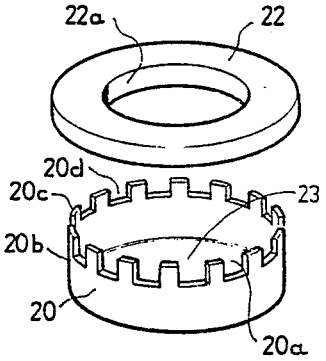
FIG. 2

FLOW REGULATOR AND WATER SPRINKLER INCLUDING SAME

BACKGROUND OF THE INVENTION

The present invention relates to flow regulators for regulating the flow of a fluid. The invention is particularly useful for regulating the flow of water to a water sprinkler, and is therefore described below with respect to this application.

There are many applications where the flow of a fluid must be maintained relatively constant under varying fluid pressure conditions. One such application is in water irrigation devices, such as water sprinklers, wherein it is desired to maintain a relatively constant flow output from each sprinkler in a long line of sprinklers even though there is a substantial pressure drop from the first sprinkler to the last sprinkler of the line, or even though the ground conditions are such that the sprinklers may be located at different elevations. Many flow regulators have been developed for this purpose, but efforts are nevertheless being continuously made to simplify the construction of such regulators, to reduce their sensitivity to clogging, and to permit quick cleaning in the event of clogging.

SUMMARY OF THE INVENTION

An object of the present invention is to provide a flow regulator having advantages in all of the above respects. Another object of the present invention is to provide a water sprinkler including the novel flow regulator.

According to the present invention, there is provided a flow regulator comprising a housing having a passageway for a fluid flowing therethrough from its inlet to its outlet; a resilient sealing member circumscribing the inlet to the passageway; and a flow regulator member overlying the passageway inlet and including a continuous, annular, side wall extending axially of and facing the annular sealing member, and a circular end wall distal from the annular sealing member and extending transversely thereof to define, between the annular sealing member and the circular end wall, a hollow chamber communicating with the inlet to the passageway; the continuous, annular side wall being formed with plurality of axially-extending teeth, the teeth being spaced circumferentially around the passageway inlet and engageable at their outer edges with the resilient sealing member such as to define flow paths in the spaces between the teeth and to confine the flow into the chamber, and thereby into the inlet to the passageway, only through these flow paths; the flow regulator member being movable axially of the passageway in response to the difference in pressure on its opposite faces to press the teeth to different depths into the resilient sealing member and thereby to regulate the flow through the flow paths by varying the dimensions of the spaces between the teeth.

According to a further aspect of the invention, there is provided a water sprinkler including a nozzle formed with mentioned passageway and including the above-described flow regulator for regulating the flow to the inlet of the passageway. More particularly, the nozzle further includes a water distribution member, e.g., a cup, at the outlet end of the nozzle passageway, and a stem passing through the nozzle passageway. The outer end of the stem is secured to the water distribution member, and the inner end of the stem is secured to the flow regulator disc. The diameter of the stem is less than the diameter of the nozzle passageway so as to outlet the water flowing through the passageway in the form of an axial jet impinging the water distribution member.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a longitudinal sectional view illustrating one form of flow regulator constructed in accordance with the present invention;

FIG. 2 is an expoloded three-dimensional view illustrating the essential elements of the flow regulator in FIG. 1; and FIG. 3 is a longitudinal sectional view illustrating a water sprinkler incorporating the flow regulator of FIGS. 1 and 2.

DESCRIPTION OF A PREFERRED EMBODIMENT

The flow regulator illustrated in FIGS. 1 and 2 comprises a housing, generally designated 2, constituted of a sleeve 4 receiving a fitting 6 at one end, and another fitting 8 at the opposite end. The two fittings are spaced from each other within sleeve 4 so as to define a compartment 10 between them. In addition, both fittings 6, 8 are formed with axially-extending passageways 12, 14 for the flow of the fluid, such as water, through passageway 12 into compartment 10 and then through passageway 14.

Freely disposed within compartment 10 is a flow regulator disc 20 which cooperates with the inlet end **14*a* of passageway 14 for controlling the flow of the fluid through that passageway in order to regulate the flow through the passageway outlet 14*b*. For this purpose, inlet end 14*a* of passageway 14 carries a resilient, annular sealing member 22. Preferably, sealing member 22 is in the form of an elastomeric ring of natural or synthetic rubber press-fitted into an annular groove 24 formed in fitting 8 at the inlet end 14*a* of passageway 14** so as to circumscribe the passageway inlet.

Flow regulator disc 20 is received within compartment 10 in alignment with passageway inlet **14*a* and is freely movable within that compartment. Member 20 is in the configuration of a circular disc formed with a circular end wall on the distal side opposite to passageway inlet 14*a*, and with a continuous annular side wall 20*b* facing the passageway inlet 14*a*. Thus, annular side wall 20*b* extends axially of and faces the annular sealing member 22, while circular disc end wall 20*a* extends transversely of the annular sealing member and defines, with the annular side wall 20*b*, a hollow chamber 23 communicating with the passageway inlet 14*a*. Annular wall 20*b* is further formed around its circumference with a plurality of axially-extending, circumferentially-spaced teeth 20*c* which are engageable at their outer edges with the resilient sealing ring 22 such as to define flow paths in the spaces 20*d* between the teeth 20*c*. The continuous side wall 20*b* formed with the teeth 20*c* thus confines the flow into chamber 23 only through the flow paths defined by the spaces 20*d* between the teeth 20*c***.

It will be seen that the flow regulator disc 20, being freely movable within compartment 10, will be moved in the axial direction towards and away from passageway inlet 14*a* in response to the difference in pressure on the opposite faces of the regulator disc. Thus, the pressure of the fluid flowing through passageway 12 is applied to the face of regulator disc 20 facing that passageway, whereas the pressure applied to the opposite face carrying the teeth 20*c* will depend on the rate of flow of the fluid through the flow paths 20*d* between the teeth.

Should the flow rate increase, the pressure on this opposite face will drop, whereby regulator disc 20 will move axially towards passageway inlet 14*a* to press teeth 20*c* deeper into the resilient sealing member 22; this movement reduces the dimensions of the spaces 20*d* between the teeth, and thereby reduces the flow through these flow paths to the inlet passageway 14*a*. On the other hand, should the flow rate between the teeth be reduced, the pressure on that face of regulator member 20 will be increased; this causes the disc to press its teeth to a lesser depth into resilient ring 22, and thereby increases the dimensions of the spaces 20*d* between the teeth to increase the rate of flow through these flow paths.

It will thus be seen that disc 20, and particularly its teeth 20*c*, cooperate with the resilient ring 22 to automatically regulate the flow of the fluid entering passageway inlet 14*a*, and thereby the flow through its outlet 14*b*.

FIG. 3 illustrates a water sprinkler equipped with the flow regulator illustrated in FIGS. 1 and 2 to regulate the flow outputted by the sprinkler. For purposes of example, the water sprinkler illustrated in FIG. 3 is of a known type, described in U.S. Pat. No. 4,356,974.

Thus, the sprinkler illustrated in FIG. 3 comprises a housing, generally designated 102, including a sleeve 104 receiving an inlet fitting 106 at one end, and an outlet fitting 108 at the opposite end. The latter fitting 108 is actually the nozzle head and is formed with a longitudinally extending passageway 114, corresponding to passageway 14 in fitting 8 of FIG. 1.

Nozzle head 108 is spaced from the inlet fitting 106 to define an inlet compartment 110, which receives a flow regulator disc 120, corresponding to disc 20 in FIGS. 1 and 2. Thus, disc 120 is also integrally formed with a circular end wall 120*a* on the side opposite to passageway inlet 14*a*, an annular wall 120*b* circumferentially around end wall 120*a*, and a plurality of teeth 120*c* spaced from each other to define the spaces 120*d* between them.

The water sprinkler illustrated in FIG. 3 further includes a stem 130 passing through the nozzle passageway 114 and of smaller outer diameter than the passageway. Thus, the water flows through passageway 114 around stem 130 and issues from the outlet end 114*b* of the nozzle in the form of an axial jet.

The inner end of stem 130 receives the flow regulator disc 120. For example, the flow regulator disc 120 may be formed with an opening through its end wall 120*a* of a diameter substantially equal to the inner end of stem 130 so as to be frictionally received on the stem. The inner end of the stem is formed with an enlarged head 132 engageable with the opposite face of the regulator disc.

The outer end of stem 130 carries a water distribution member in the form of a thin-walled cup 134 for receiving the axial jet of water issuing from passageway 114. Cup 134 is dimensioned such that, during its operating condition as illustrated in FIG. 3, the outer edge 136 of its rim is spaced slightly from the upper flat face 138 of nozzle 108.

It will thus be seen that, because of the clearance between the outer face of stem 130 and the inner face of passageway 114, the stem is movable laterally within the passageway; and because of the clearance between the outer edge of cup rim 136 and the outer face of nozzle 108, the stem is also movable axially within passageway 114.

The water sprinkler illustrated in FIG. 3 operates as follows:

The pressurized water is fed via a tube 140 and inlet fitting 106 into chamber 110, and from there it passes through the spaces 120*d* between the teeth 120*c* of flow regulator disc 120 into the inlet 114*a* of passageway 114. The water then passes through the clearance between stem 130 and the sides of the passageway, exiting from the outlet end 114*b* of the passageway in the form of an axial jet. The jet fills cup 134, forming a water cushion therein, which water cushion reflects the jet back to the outer face 138 of nozzle 108. The water is then deflected laterally along the outer face 138 of nozzle so as to distribute the water laterally around the sprinkler.

Should the pressure of the water into inlet chamber 110 increase, thereby increasing the flow through the spaces 120*d* into the nozzle passageway 114, this will decrease the pressure on the respective face of flow regulator disc 120; thus, the inlet pressure applied to the opposite face of the disc will move the disc towards resilient ring 120, thereby more deeply embedding teeth 120*c* into the disc. This decreases the dimensions of the flow paths defined by spaces 120*d* between the teeth, thereby reducing the flow through the spaces into the nozzle passageway 114.

In addition, the impingement of the jet issuing from the outlet end 114*d* of nozzle 108 against cup 134 also produces a force moving disc 120 in the direction of the resilient ring 122, thereby also decreasing the dimensions of the flow paths defined by the spaces 120*d* with an increase in flow rate.

It will thus be seen that the regulator disc 120 in the sprinkler illustrated in FIG. 3 will regulate the flow through the nozzle 108 to maintain a relatively constant flow rate despite the variations in the inlet water pressure.

Since the water flows into nozzle passageway 114 through a plurality of parallel flow paths, namely the spaces 120*d* between the teeth 120*c*, it will be appreciated that the illustrated arrangement has a low sensitivity to clogging since if one such path is clogged by a foreign particle, the flow will be insignificantly affected because of the plurality of other parallel paths. The sprinkler illustrated in FIG. 3 may also be cleaned of any clogging particles by merely pressing down cup 134, which thereby moves the flow regulator disc 120 away from resilient ring 122, whereby any particles wedged between the teeth of the disc and the ring will be flushed out.

While the invention has been described with respect to one preferred embodiment, it will be appreciated that many other variations, modifications and applications of the invention may be made.

What is claimed is:

1. A flow regulator comprising:

a housing having a passageway for a fluid flowing therethrough from its inlet to its outlet;

a resilient sealing member circumscribing the inlet to said passageway;

and a flow regulator member overlying said passageway inlet and including a continuous, annular, side wall extending axially of and facing said annular sealing member, and a circular end wall distal from the annular sealing member and extending transversely thereof to define, between the annular sealing member and the circular end wall, a hollow chamber communicating with said inlet to the passageway;

said continuous, annular side wall being formed with a plurality of axially-extending teeth;

said teeth being spaced circumferentially around said passageway inlet and engageable at their outer edges with said resilient sealing member such as to define flow paths in the spaces between said teeth and to confine the flow into the said chamber, and thereby into said inlet to the passageway, only through said flow paths;

said flow regulator member being movable axially of the passageway in response to the difference in pressure on its opposite faces to press said teeth to different depths into said resilient sealing member and thereby to regulate the flow through said flow paths by varying the dimensions of the spaces between said teeth.

2. The flow regulator according to claim 1, wherein said resilient sealing member is of circular configuration and is received within an annular recess circumscribing said passageway inlet.

3. The flow regulator according to claim 1, wherein said housing includes a compartment at the inlet end of said passageway, said flow regulator member being freely movable within said compartment.

4. A flow regulator comprising:

a housing having a passageway for a fluid flowing therethrough from its inlet to its outlet;

a resilient sealing member circumscribing the inlet to said passageway;

a flow regulator member overlying said passageway inlet and including a continuous, annular, side wall extending axially of and facing said annular sealing member, and a circular end wall distal from the annular sealing member and extending transversely thereof to define, between the annular sealing member and the circular end wall, a hollow chamber communicating with said inlet to the passageway;

said continuous, annular side wall being formed with a plurality of axially-extending teeth;

said housing including a compartment at the inlet end of said passageway, said flow regulator member being freely movable within said compartment;

said teeth being spaced circumferentially around said passageway inlet and engageable at their outer edges with said resilient sealing member such as to define flow paths in the spaces between said teeth and to confine the flow into said chamber, and thereby into said inlet to the passageway, only through said flow paths;

said flow regulator member being movable axially of the passageway in response to the difference in pressure on its opposite faces to press said teeth to different depths into said resilient sealing member and thereby to regulate the flow through said flow paths by varying the dimensions of the spaces between said teeth.

5. The flow regulator according to claim 4, wherein said resilient sealing member is of circular configuration and is received within an annular recess circumscribing said passageway inlet.

6. A water sprinkler including a nozzle having said passageway formed therethrough, and a flow regulator in accordance with claim 1 for regulating the flow through said nozzle passageway.

7. The water sprinkler according to claim 6, wherein said nozzle further includes a water distribution member at the outlet end of said nozzle passageway, and a stem passing through said nozzle passageway, the outer end of said stem being secured to said water distribution member, and the inner end of said stem receiving said flow regulator member, the diameter of said stem being less than the diameter of said nozzle passageway so as to outlet the water flowing through said passageway in the form of an axial jet impinging said water distribution member.

8. The water sprinkler according to claim 7, wherein said water distribution member is a cup which reflects the water jet issuing from the nozzle back to the face of the nozzle, which latter face deflects the water laterally of the nozzle.

* * * * *